US009286831B2

(12) United States Patent
Qing et al.

(10) Patent No.: US 9,286,831 B2
(45) Date of Patent: Mar. 15, 2016

(54) AC DRIVE CIRCUIT FOR OLED, DRIVE METHOD AND DISPLAY APPARATUS

(71) Applicants: BOE TECHNOLOGY GROUP CO., LTD., Beijing (CN); Chengdu BOE Optoelectronics Technology Co., Ltd., Chengdu, Sichuan Province (CN)

(72) Inventors: Haigang Qing, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan Province (CN)

( * ) Notice: Subject to any disclaimer, the term of this patent is extended or adjusted under 35 U.S.C. 154(b) by 0 days.

(21) Appl. No.: 14/369,416

(22) PCT Filed: Dec. 16, 2013

(86) PCT No.: PCT/CN2013/089509

§ 371 (c)(1),
(2) Date: Jun. 27, 2014

(87) PCT Pub. No.: WO2015/018161

PCT Pub. Date: Feb. 12, 2015

(65) Prior Publication Data

US 2015/0221252 A1 Aug. 6, 2015

(30) Foreign Application Priority Data

Aug. 7, 2013 (CN) ..... 2013 1 0341693

(51) Int. Cl.
*G09G 3/30* (2006.01)
*G09G 3/32* (2006.01)
*H05B 33/08* (2006.01)

(52) U.S. Cl.
CPC ..... *G09G 3/3233* (2013.01); *G09G 3/3291* (2013.01); *H05B 33/0896* (2013.01);

(Continued)

(58) Field of Classification Search
CPC ..... G09G 3/3208
USPC ..... 345/76, 77
See application file for complete search history.

(56) References Cited

U.S. PATENT DOCUMENTS

2005/0068288 A1 3/2005 Jang et al.
2010/0164847 A1* 7/2010 Lee et al. ..... 345/77

(Continued)

FOREIGN PATENT DOCUMENTS

CN 1855198 A 11/2006
CN 1874627 A 12/2006

(Continued)

OTHER PUBLICATIONS

Office Action issued in Chinese Application No. 201310341693.6 dated Feb. 2, 2015.

(Continued)

*Primary Examiner* — Roy Rabindranath
(74) *Attorney, Agent, or Firm* — Nath, Goldberg & Meyer; Joshua B. Goldberg; Christopher Thomas

(57) ABSTRACT

An AC drive circuit for OLED comprises a light emitting control unit, a charging control unit, a drive unit, a storage unit, a first voltage signal input terminal, a second voltage signal input terminal and a third voltage signal input terminal. The AC drive circuit enables that the current flowing in an OLED is independent of the internal resistance of the circuit, thus the brightness of the OLED will not be influenced by the internal resistance of the circuit. Meanwhile, the AC drive circuit compensates the threshold voltage of the drive transistor, thus the influence of the threshold voltage of the drive transistor on the current of the OLED for emitting light is eliminated. In addition, the AC drive circuit reversely biases the OLED, thereby the un-recombined carriers accumulated at the light emitting interface inside the OLED and the built-in electrical field formed by these carriers are eliminated.

12 Claims, 4 Drawing Sheets

(52) U.S. Cl.
CPC ..... *G09G2300/0814* (2013.01); *G09G 2300/0819* (2013.01); *G09G 2300/0842* (2013.01); *G09G 2300/0861* (2013.01); *G09G 2310/0251* (2013.01); *G09G 2320/0233* (2013.01); *G09G 2320/045* (2013.01)

(56) References Cited

U.S. PATENT DOCUMENTS

| | | | | |
|---|---|---|---|---|
| 2012/0069059 | A1* | 3/2012 | Lee | 345/690 |
| 2012/0161637 | A1 | 6/2012 | Lee et al. | |

FOREIGN PATENT DOCUMENTS

| | | | |
|---|---|---|---|
| CN | 1964585 | A | 5/2007 |
| CN | 101231821 | A | 7/2008 |
| CN | 102122490 | A | 7/2011 |
| CN | 102222468 | A | 10/2011 |
| CN | 202110796 | U | 1/2012 |
| CN | 102915709 | A | 2/2013 |
| CN | 103137067 | A | 6/2013 |
| CN | 103187024 | A | 7/2013 |
| CN | 103198788 | A | 7/2013 |
| CN | 203085137 | U | 7/2013 |
| CN | 203520830 | U | 4/2014 |
| EP | 2602783 | A1 | 6/2013 |
| KR | 10-0833753 | B1 | 5/2008 |
| KR | 100836431 | B1 | 6/2008 |
| KR | 10-2013-0062573 | A | 6/2013 |

OTHER PUBLICATIONS

Search Report issued in International Application No. PCT/CN2013/089509, fifteen (15) pages.
Korean Office Action dated Apr. 30, 2015 issued in corresponding Korean Patent Application No. 10-2014-7017717.
Chinese Office Action dated Jun. 12, 2015 issued in corresponding Chinese Patent Application No. 201310341693.6.
The Extended European Search Report dated Sep. 11, 2015 corresponding to European application No. 13863697.2-1904.
Written Opinion of the International Searching Authority dated May 14, 2014 corresponding to International application No. PCT/CN2013/089509.

* cited by examiner

AC DRIVE CIRCUIT FOR OLED, DRIVE METHOD AND DISPLAY APPARATUS

This is a National Phase Application filed under 35 U.S.C. 371 as a national stage of PCT/CN2013/089509, filed Dec. 16, 2013, and claims priority benefit from Chinese Application No. 201310341693.6, filed Aug. 7, 2013, the content of each of which is hereby incorporated by reference in its entirety.

TECHNICAL FIELD

The present invention relates to the field of display technology, and particularly, to an AC drive circuit for OLED, a drive method and a display apparatus.

BACKGROUND ART

In a traditional display apparatus, a drive circuit for driving an OLED to emit light is a 2T1C (two thin film transistors and one capacitor) circuit which contains only two transistors, wherein the first transistor T1 functions as a switch, and the second transistor DTFT functions as a drive transistor. The operation of the 2T1C circuit is relatively simple. During the operation of the 2T1C circuit, when the scanning signal is at a low level, the first transistor T1 is turned on and the capacitor C is charged by a gray scale voltage on the data line, and when the scanning signal is at a high level, the first transistor T1 is turned off and the gray scale voltage is held in the capacitor C. As the supply voltage is relatively high, the second transistor DTFT is saturated and generates a current for driving the OLED to emit light.

However, there are following technical problems when the traditional 2T1C circuit is used to drive the OLED to emit light: 1) brightness uniformity of the display panel is poor, and brightness of the OLED and brightness of the display panel are lowered; 2) lifetime of the OLED is short.

The technical problem 1) is due to the fact that: a) as the manufacturing process such as Low-Temperature Poly-Si (LTPS) technology is not matured, even if the same technical parameters are used, there are obvious differences among the threshold voltages $V_{th}$ of the transistors in different positions of a display panel, and as the drive current for driving an OLED to emit light is related to the threshold voltage $V_{th}$ of the drive transistor, when the same gray scale voltage is inputted, different threshold voltages of the drive transistors will result in different drive currents, resulting in different brightness in different positions of the display panel and poor uniformity of brightness thereof; b) as there is an internal resistance for the circuit, once a current flows through the circuit, a voltage drop must be generated by the internal resistance of the circuit, the voltage difference across the capacitor C will be influenced, for example, the voltage difference across the capacitor C cannot reach a required voltage, thereby brightness of the OLED is lowered; c) with the use of the OLED, many un-recombined carriers are accumulated at the internal interface of the light emitting layer of the OLED, resulting in a built-in electrical field inside the OLED, which causes the threshold voltage $V_{th}$ of the OLED to drift (in other words, rise steadily), thereby brightness of the OLED is lowered, and brightness of the display panel is lowered.

The technical problem 2) is due to the fact that: with the use of the OLED, some locally conductive microcosmic small channels (filaments) are produced, wherein the filaments are actually caused by some "pinholes" and will influence lifetime of the OLED.

Currently, most of drive circuits for OLED only avoid drift of the threshold voltage of the OLED by using the AC drive to eliminate the locally conductive microcosmic small channels (filaments) of the OLED so that degenerating of the characteristics of the OLED and aging of the OLED are delayed, but influence of the threshold voltage of the drive transistor on brightness of the display panel is not considered; or, most of drive circuits for OLED only compensate for the threshold voltage of the drive transistor to eliminate influence of the threshold voltage of the drive transistor on brightness of the display panel, but degenerating of the characteristics of the OLED and aging of the OLED are not delayed, and lifetime of the OLED is short.

SUMMARY

Technical Problem to be Solved

The technical problem to be solved by the present invention is to provide an AC drive circuit for OLED, a drive method and a display apparatus, to solve the problems of existing drive circuits for OLED, such as un-uniformity of brightness of display panel, degenerating of the characteristics of OLED, short lifetime of OLED, and so on.

Technical Solutions

In order to solve the above technical problems, the present invention provides an AC drive circuit for OLED comprising a charging control unit, a light emitting control unit, a storage unit and a drive unit, wherein the charging control unit is used for controlling the AC drive circuit to charge the storage unit, and the light emitting control unit is used for controlling the AC drive circuit so that the storage unit controls the drive unit to drive an OLED to emit light.

Further, the AC drive circuit further comprises a first signal input terminal, a second signal input terminal and a third signal input terminal, wherein the first signal input terminal is connected with the light emitting control unit and the storage unit, the second signal input terminal is connected with a cathode of the OLED, and the third signal input terminal is connected with the charging control unit.

Further, the light emitting control unit comprises: a light emitting control signal input terminal for inputting a light emitting control signal; a first transistor, wherein a gate electrode of the first transistor is connected with the light emitting control signal input terminal, a source electrode of the first transistor is connected with the first signal input terminal, and a drain electrode of the first transistor is connected with the drive unit; a fourth transistor, wherein a gate electrode of the fourth transistor is connected with the light emitting control signal input terminal, a source electrode of the fourth transistor is connected with the drive unit, and a drain electrode of the fourth transistor is connected with an anode of the OLED.

Further, the charging control unit comprises: a scanning signal input terminal for inputting a scanning signal; a data signal input terminal for inputting a data signal; a second transistor, a gate electrode of the second transistor is connected with the scanning signal input terminal, a source electrode of the second transistor is connected with the data signal input terminal, and a drain electrode of the second transistor is connected with the drain electrode of the first transistor; a third transistor, a gate electrode of the third transistor is connected with the scanning signal input terminal, a source electrode of the third transistor is connected with the storage unit, and a drain electrode of the third transistor is connected with the drive unit; a fifth transistor, wherein a gate electrode of the fifth transistor is connected with the scanning signal input terminal, a source electrode of the fifth transistor is connected with the drain electrode of the fourth transistor, and a drain electrode of the fifth transistor is connected with the third signal input terminal.

Further, the drive unit comprises: a drive transistor, wherein a gate electrode of the drive transistor is connected with the storage unit, a source electrode of the drive transistor is connected with the drain electrode of the first transistor, and a drain electrode of the drive transistor is connected with the source electrode of the fourth transistor.

Further, the storage unit comprises: a capacitor, wherein one terminal of the capacitor is connected with the first signal input terminal, and the other terminal of the capacitor is connected with the source electrode of the third transistor.

Further, the AC drive circuit further comprises: a first voltage source for supplying a first voltage control signal to the first signal input terminal.

Further, the AC drive circuit further comprises: a second voltage source for supplying a second voltage control signal to the second signal input terminal.

Further, the AC drive circuit further comprises: a third voltage source for supplying a third voltage control signal to the third signal input terminal.

Further, all of the first transistor, the second transistor, the third transistor, the fourth transistor, the fifth transistor, and the drive transistor are P-type transistors.

Further, a voltage magnitude of the first voltage control signal is larger than a voltage magnitude of the second voltage control signal.

Further, the voltage magnitude of the second voltage control signal is larger than that of the third voltage control signal.

The present invention also provides a display apparatus comprising the above AC drive circuit for OLED.

The present invention also provides a drive method of an AC drive circuit for OLED, wherein the AC drive circuit comprises a charging control unit, a light emitting control unit, a storage unit and a drive unit, the charging control unit is used for controlling the AC drive circuit to charge the storage unit, and the light emitting control unit is used for controlling the AC drive circuit so that the storage unit controls the drive unit to drive an OLED to emit light, the drive method comprises: removing data signals stored in the storage unit; charging the storage unit so that new data signals are stored in the storage unit; isolating the new data signals stored in the storage unit; and controlling the drive unit by the storage unit so that the drive unit drives the OLED to emit light.

Further, the drive method comprises reversely biasing the OLED while removing data signals stored in the storage unit.

Advantageous Technical Effects

First, the AC drive circuit for OLED according to the present invention controls the second, the third and the fifth transistors to be turned off, and controls the first and the fourth transistors to be turned on, so that when the OLED emits light normally, the gate electrode of the drive transistor connected with one terminal of the storage capacitor is in a suspended state, and the other terminal of the storage capacitor is connected with the first voltage source, thus the changes of the voltage caused by the internal resistance of the circuit will not influence the voltage difference across the capacitor, thereby a constant gate-source voltage of the drive transistor is ensured, and the current flowing in the OLED is independent of the internal resistance of the circuit, ensuring a constant current flowing in the OLED and a uniform brightness of the OLED.

Second, the AC drive circuit for OLED according to the present invention writes the threshold voltage of the drive transistor into the storage capacitor while data signals are written into the storage capacitor, thereby the influence of the threshold voltage of the drive transistor on the current of the OLED for emitting light is compensated, ensuring the uniformity of the brightness of the display panel.

Third, the AC drive circuit for OLED according to the present invention reversely biases the OLED, thereby the un-recombined carriers accumulated at the light emitting interface inside the OLED and the built-in electrical field formed by these carriers are eliminated, avoiding the drift of the threshold voltage $V_{th}$ of the OLED, and burning out the locally conductive microcosmic small channels (filaments) in the OLED to increase the lifetime of the OLED.

Fourth, the AC drive circuit for OELD according to the present invention has a simple structure, wherein thin film transistors manufactured by amorphous-silicon process, poly-silicon process, oxide process, etc. may be used, and the operation of the circuit is simple and convenient, facilitating mass production and application.

DETAILED DESCRIPTION OF THE PREFERRED EMBODIMENTS

Specific embodiments of the present invention will be described in detail below with reference to the drawings. The descriptions of the embodiments are illustrative, but not to limit the scope of the present invention.

In order to solve the problems of existing drive circuits for OLED, such as un-uniformity of the brightness of the display panel, degenerating of the characteristics of the OLED, and short lifetime of the OLED, embodiments of the present invention provide an AC drive circuit for OLED, a drive method and a display apparatus.

Embodiment 1

Figure 1:
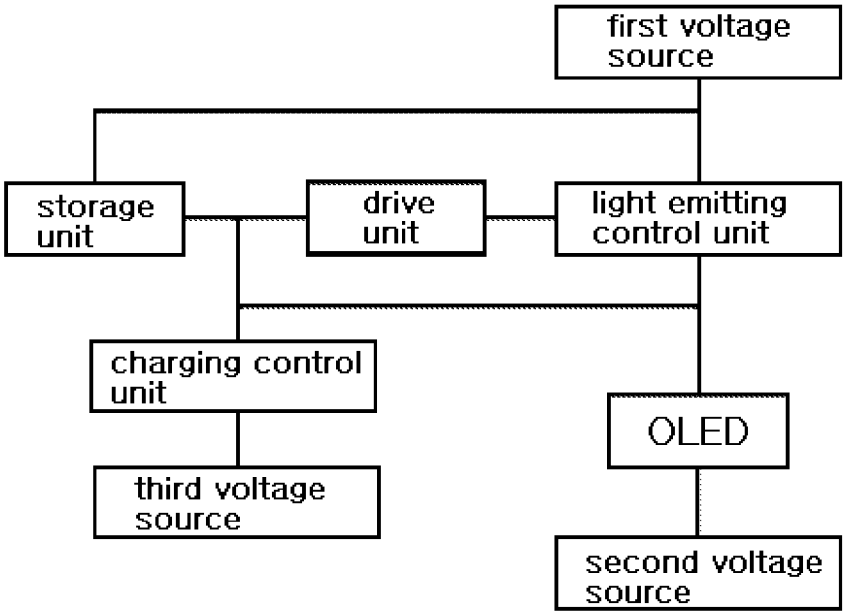
FIG. 1 is a block diagram of an AC drive circuit for OLED according to an embodiment of the present invention.

FIG. 1 is a block diagram of the AC drive circuit for OLED according to an embodiment of the present invention. As shown in FIG. 1, the AC drive circuit for OLED of the present embodiment comprises a charging control unit, a light emitting control unit, a storage unit, a drive unit, a first signal input terminal, a second signal input terminal and a third signal input terminal, wherein the charging control unit is used for controlling the AC drive circuit to charge the storage unit, the light emitting control unit is used for controlling the AC drive circuit so that the storage unit controls the drive unit to drive the OLED to emit light, the first signal input terminal is connected with the light emitting control unit and the storage unit, the second signal input terminal is connected with a cathode of the OLED, and the third signal input terminal is connected with the charging control unit.

Preferably, the light emitting control unit comprises: a light emitting control signal input terminal for inputting a light emitting control signal; a first transistor, wherein a gate electrode of the first transistor is connected with the light emitting control signal input terminal, a source electrode of the first transistor is connected with the first signal input terminal, and a drain electrode of the first transistor is connected with the drive unit; a fourth transistor, wherein a gate electrode of the fourth transistor is connected with the light emitting control signal input terminal, a source electrode of the fourth transistor is connected with the drive unit, and a drain electrode of the fourth transistor is connected with an anode of the OLED.

Preferably, the charging control unit comprises: a scanning signal input terminal for inputting a scanning signal; a data signal input terminal for inputting a data signal; a second transistor, wherein a gate electrode of the second transistor is connected with the scanning signal input terminal, a source electrode of the second transistor is connected with the data signal input terminal, and a drain electrode of the second transistor is connected with the drain electrode of the first transistor; a third transistor, wherein a gate electrode of the third transistor is connected with the scanning signal input terminal, a source electrode of the third transistor is connected with the storage unit, and a drain electrode of the third transistor is connected with the drive unit; a fifth transistor, wherein a gate electrode of the fifth transistor is connected with the scanning signal input terminal, a source electrode of the fifth transistor is connected with the drain electrode of the fourth transistor, and a drain electrode of the fifth transistor is connected with the third signal input terminal.

Preferably, the drive unit comprises: a drive transistor, wherein a gate electrode of the drive transistor is connected with the storage unit, a source electrode of the drive transistor is connected with the drain electrode of the first transistor, and a drain electrode of the drive transistor is connected with the source electrode of the fourth transistor.

Preferably, the storage unit comprises: a capacitor, wherein one terminal of the capacitor is connected with the first signal input terminal, and the other terminal of the capacitor is connected with the source electrode of the third transistor.

In the present embodiment, the signal input terminals may be voltage signal input terminals or current signal input terminals, and may be connected with an external voltage source or current source.

Preferably, the AC drive circuit for OLED of the present embodiment further comprises a voltage source and/or a current source supplying signals to the respective signal input terminals.

Preferably, the AC drive circuit for OLED of the present embodiment further comprises: a first voltage source for supplying a first voltage control signal to the first signal input terminal.

Preferably, the AC drive circuit for OLED of the present embodiment further comprises: a second voltage source for supplying a second voltage control signal to the second signal input terminal.

Preferably, the AC drive circuit for OLED of the present embodiment further comprises: a third voltage source for supplying a third voltage control signal to the third signal input terminal.

All of the first transistor, the second transistor, the third transistor, the fourth transistor, the fifth transistor, and the drive transistor are P-type transistors.

It should be noted that the source electrodes and the drain electrodes of the respective transistors in the present embodiment may be exchanged. That is, the scope of the present embodiment covers the case that the source electrodes and the drain electrodes of the respective transistors in the present embodiment are exchanged.

Wherein, the voltage magnitude of the first voltage control signal outputted by the first voltage source is larger than the voltage magnitude of the second voltage control signal outputted by the second voltage source, and the voltage magnitude of the second voltage control signal outputted by the second voltage source is larger than the voltage magnitude of the third voltage control signal outputted by the third voltage source. That is, the first voltage control signal, the second voltage control signal and the third voltage control signal respectively outputted by the first voltage source, the second voltage source and the third voltage source have voltage magnitudes $V_{DD}$, $V_{SS}$ and $V_{ref}$ respectively, and $V_{DD}>V_{SS}>V_{ref}$.

Figure 2:
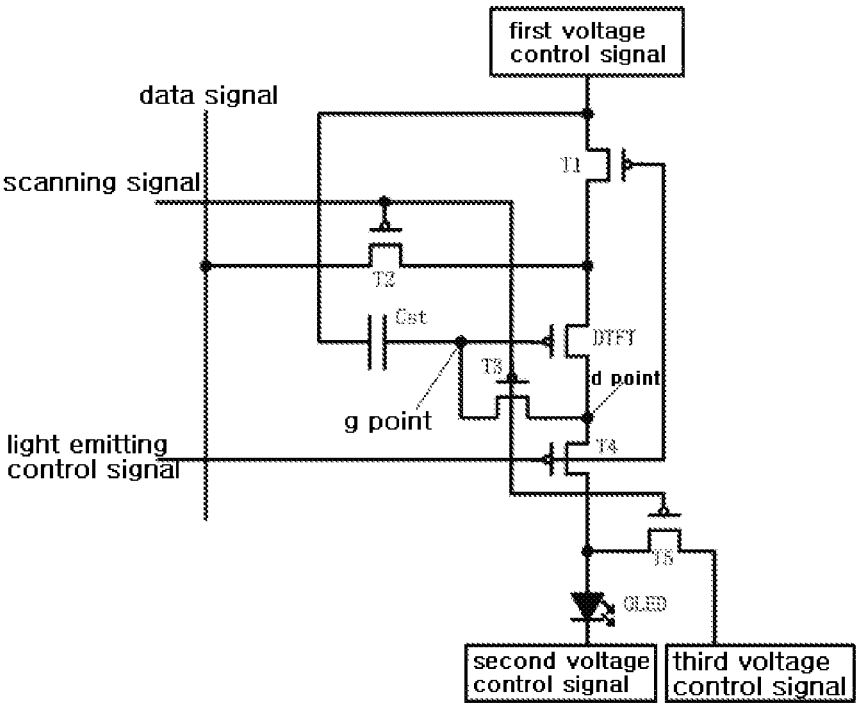
FIG. 2 is a circuit diagram of the AC drive circuit for OLED according to an embodiment of the present invention.

FIG. 2 is a circuit diagram of the AC drive circuit for OLED according to an embodiment of the present invention.

The AC drive circuit for OLED of the present embodiment controls the first transistor T1, the second transistor T2, the third transistor T3, the fourth transistor T4, the fifth transistor T5, the drive transistor DTFT and the capacitor $C_{st}$ by the scanning signal, the light emitting control signal and the data signal, so that the current flowing in the OLED is independent of the internal resistance of the circuit, eliminating the influence of the internal resistance of the circuit on the current of the OLED for emitting light. Moreover, the AC drive circuit for OLED of the present embodiment writes the threshold voltage of the drive transistor into the storage capacitor while data signals are written into the storage capacitor, thereby the influence of the threshold voltage of the drive transistor on the current of the OLED for emitting light is compensated, ensuring the uniformity of the brightness of the display panel. In addition, the AC drive circuit for OLED of the present embodiment reversely biases the OLED, thereby the un-recombined carriers accumulated at the light emitting interface inside the OLED and the built-in electrical field formed by these carriers are eliminated, avoiding the drift of the threshold voltage of the OLED, and burning out the locally conductive microcosmic small channels (filaments) in the OLED to increase the lifetime of the OLED.

Embodiment 2

The present embodiment of the present invention provides a display apparatus, comprising the AC drive circuit for OLED of the above embodiment 1.

Embodiment 3

Figure 3:
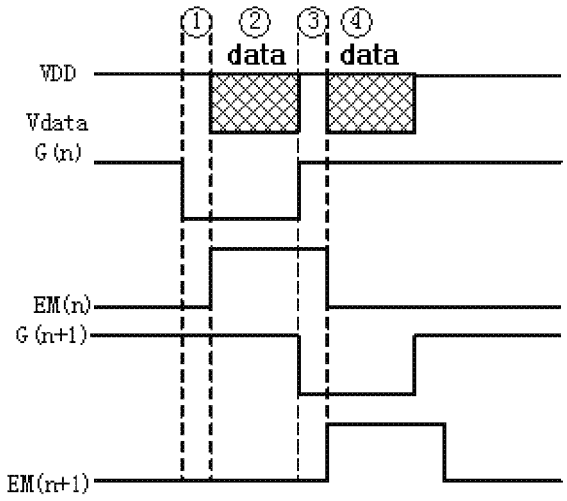
FIG. 3 is a drive timing diagram of the AC drive circuit for OLED according to an embodiment of the present invention.

The present embodiment of the present invention provides a drive method of an AC drive circuit for OLED. The drive method comprises four stages, and FIG. 3 shows the drive timing diagram of these four stages. In FIG. 3, $V_{data}$ represents the data signal voltage, G(n) represents the voltage magnitude of the scanning signal for the $n^{th}$ row, and EM(n) represents the voltage magnitude of the light emitting control signal for the $n^{th}$ row.

The specific operations during the four stages are as follows.

Stage 1: removing data signals stored in the storage unit.

Specifically, in this stage, making the scanning signal and the light emitting control signal to be at low levels, so that the first transistor T1 and the fourth transistor T4 contained in the light emitting control unit, and the second transistor T2, the third transistor T3 and the fifth transistor T5 contained in the charging control unit are all turned on, thereby the data signals stored in the storage capacitor are removed, and the OLED is reversely biased.

Figure 4:
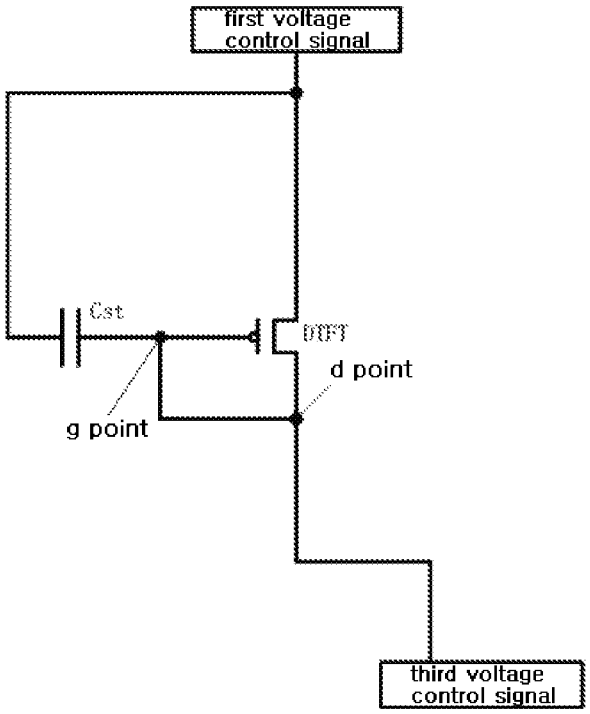
FIG. 4 is an equivalent circuit diagram of the AC drive circuit for OLED when the data signals stored in the storage unit are removed according to an embodiment of the present invention.

As the third transistor T3 is turned on, the gate electrode and the drain electrode of the drive transistor DTFT are connected together, that is, the drive transistor DTFT is connected as a diode. Moreover, as both of the fourth transistor T4 and the fifth transistor T5 are turned on, the potential of the gate electrode of the drive transistor DTFT connected with the capacitor $C_{st}$ is pulled down to $V_{ref}$, and the data signal voltage on the gate electrode of the drive transistor DTFT when the pervious frame is displayed is cleared. At this time, the data signal is at a high level $V_{DD}$ (after the first transistor T1 and the second transistor T2 are turned on, both of the data signal and the source electrode of the drive transistor DTFT are connected with the first voltage control signal), thereby both of the data signal and the voltage $V_{DD}$ of the first voltage control signal are applied to the source electrode of the drive transistor DTFT. In addition, as the fifth transistor T5 is turned on, the potential of the anode of the OLED becomes the voltage $V_{ref}$ of the third voltage control signal. Then, as the voltage $V_{ref}$ of the third voltage control signal is smaller than the voltage $V_{SS}$ of the second voltage control signal, the OLED is reversely biased. The OLED varies from being forward biased (when the OLED emits light) to being reversely biased, thus an AC drive for the OLED is achieved. When the OLED is reversely biased, the OLED does not emit light, but the un-recombined carriers accumulated at the light emitting interface inside the OLED move inversely, thereby the un-recombined carriers accumulated at the light emitting interface inside the OLED and the built-in electrical field formed by these carriers are eliminated, avoiding the drift of the threshold voltage of the OLED. In addition, when the OLED is reversely biased, the locally conductive microcosmic small channels (filaments) are burned out, increasing the lifetime of the OLED. In this stage, the equivalent circuit diagram of the AC drive circuit for OLED in FIG. 2 is shown in FIG. 4.

Stage 2: charging the storage unit, so that new data signals are stored in the storage unit.

In this stage, the scanning signal is at a low level and the light emitting control signal is at a high level, thus the second transistor T2, the third transistor T3 and the fifth transistor T5 contained in the charging control unit are turned on, and the first transistor T1 and the fourth transistor T4 contained in the light emitting control unit are turned off, thereby the storage capacitor $C_{st}$ is charged.

That is, the voltage of the data signal jumps from $V_{DD}$ to be the data signal voltage $V_{data}$, the drive transistor DTFT is still connected as a diode, and the first transistor T1 and the fourth transistor T4 are turned off, thereby the capacitor $C_{st}$ is charged through the drive transistor DTFT from the source electrode of the drive transistor DTFT by the data signal voltage $V_{data}$. When the potential at the gate electrode of the drive transistor DTFT rises to be $V_{data}-|V_{thd}|$, the drive transistor DTFT is turned off, and $V_{thd}$ represents the threshold voltage of the drive transistor. At this time, the voltage of the first voltage control signal has a designed voltage magnitude. In order to distinguish the voltage of the first voltage control signal subjected to a voltage drop due to the internal resistance of the circuit (when a current flows through, that is, when the OLED emits light) and the voltage of the first voltage control signal without voltage drop (when there is no current flowing through), $V_{DD0}$ is used for indicating the voltage of the first voltage control signal without voltage drop. Thus, in this stage, the voltage across the capacitor $C_{st}$ is as follows.

$$V_{C_{st}}=V_{DD0}-(V_{data}|^{V}{}_{thd}|)$$

Figure 5:
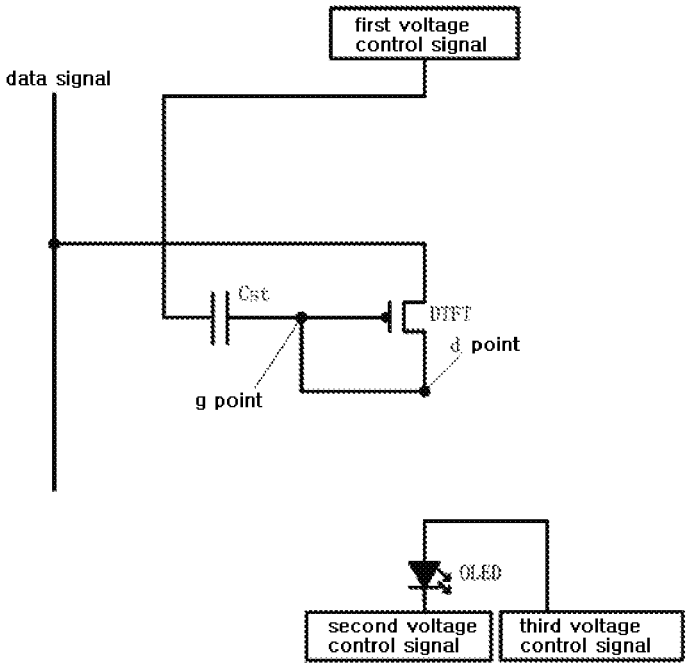
FIG. 5 is an equivalent circuit diagram of the AC drive circuit for OLED when the storage unit is charged according to an embodiment of the present invention.

Moreover, in this stage, the fifth transistor T5 is turned on. At this time, as the voltage of the third voltage control signal $V_{ref}$ is smaller than the voltage of the second voltage control signal $V_{SS}$, the OLED is still reversely biased, the un-recombined carriers accumulated at the light emitting interface inside the OLED are continuously depleted to decrease the built-in electrical field formed by these carriers constantly, and the locally conductive microcosmic small channels (filaments) in the OLED are continuously burned out, delaying the aging of the OLED. In this stage, the equivalent circuit diagram of the AC drive circuit for OLED in FIG. 2 is shown in FIG. 5.

Stage 3: isolating the new data signals stored in the storage unit.

In this stage, making the scanning signal and the light emitting control signal to be at high levels, so that the first transistor T1 and the fourth transistor T4 contained in the light emitting control unit, and the second transistor T2, the third transistor T3 and the fifth transistor T5 contained in the charging control unit are all turned off, thereby the new data signals stored in the capacitor $C_{st}$ are isolated.

In this stage, the light emitting control signal is still at a high level, so as to avoid the unnecessary noise that may be generated when the voltage of the light emitting control signal jumps while the voltage of the scanning signal jumps.

Figure 6:
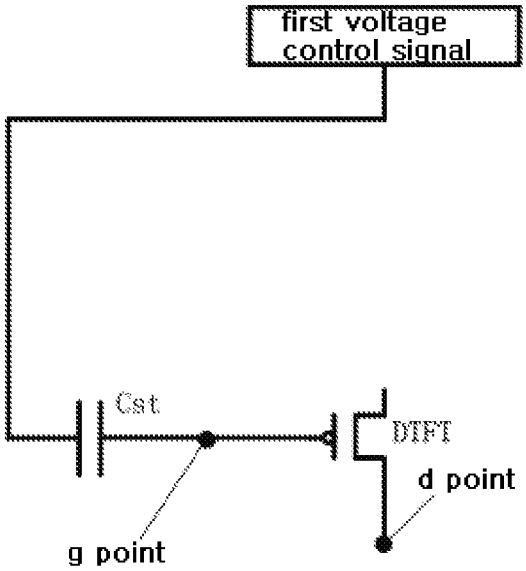
FIG. 6 is an equivalent circuit diagram of the AC drive circuit for OLED when new data signals stored in the storage unit are isolated according to an embodiment of the present invention.

At this time, the OLED is still reversely biased and not turned on. As the fifth transistor T5 is turned off, the voltage of the third voltage control signal $V_{ref}$ is not applied to the anode of the OLED. In this stage, the equivalent circuit diagram of the AC drive circuit for OLED in FIG. 2 is shown in FIG. 6.

Stage 4: controlling the drive unit by the storage unit so as to drive the OLED to emit light.

In this stage, making the scanning signal to be at a high level, and making the light emitting control signal to be at a low level, so that all of the second transistor T2, the third transistor T3 and the fifth transistor T5 contained in the charging control unit are turned off, and the first transistor T1 and the fourth transistor T4 contained in the light emitting control unit are turned on, thereby the storage capacitor $C_{st}$ controls the drive transistor DTFT to drive the OLED to emit light.

At this time, the OLED is forward biased, and starts to emit light. As the third transistor T3 is turned off, the gate electrode of the drive transistor DTFT is suspended (also considered to be turned on). At this time, one terminal of the capacitor $C_{st}$ is suspended, and the other terminal of the capacitor $C_{st}$ is connected with the voltage of the first voltage control signal $V_{DD}$, thus the voltage across the capacitor $C_{st}$ is still the voltage reached in the Stage 2, and the voltage difference between the two terminals of the capacitor $C_{st}$ will not be influenced by the voltage drop of the voltage of the first voltage control signal $V_{DD}$, which is due to the fact that there is current flowing through. At this time, the gate-source voltage $V_{sg}$ of the drive transistor DTFT is the voltage $V_C$ across the capacitor $C_{st}$ as follows:

$$V_{sg}=V_{C_{st}}=V_{DD0}-(V_{data}-|V_{thd}|)=V_{DD0}-V_{data}+|V_{thd}|$$

Thus, the magnitude of the saturation current flowing in the drive transistor DTFT (that is, the current of the OLED for emitting light) $L_{oled}$ is as follows:

$$I_{oled}=K_d(V_{sg}-|V_{thd}|)^2=K_d(V_{DD0}-V_{data}+|V_{thd}|-|V_{thd}|)^2=K_d(V_{DD0}-V_{data})^2$$

$$I_{oled}=K_d(V_{sg}-|V_{thd}|)^2=K_d(V_{DD0}-V_{data})^2$$

Figure 7:
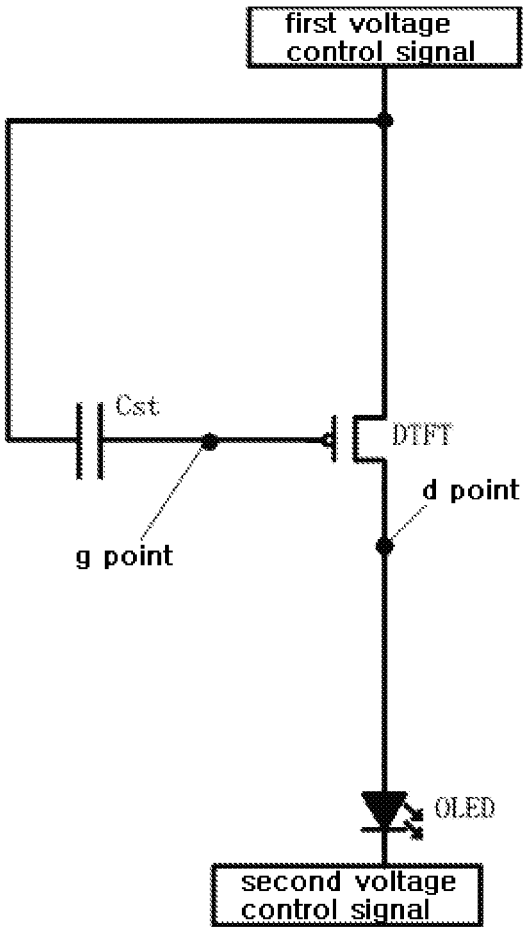
FIG. 7 is an equivalent circuit diagram of the AC drive circuit for OLED when the storage unit controls the drive unit to drive the OLED to emit light according to an embodiment of the present invention.

Wherein, $K_d$ is a constant related to the process and the design, and $V_{thd}$ represents a threshold voltage of the drive transistor DTFT. In this stage, the equivalent circuit diagram of the AC drive circuit for OLED in FIG. 2 is shown in FIG. 7.

From the above formulas, the second transistor, the third transistor and the fifth transistor are turned off, and the first transistor and the fourth transistor are turned on, thus the current flowing in the OLED is independent of the internal resistance of the circuit, ensuring a constant current flowing in the OLED and uniform brightness of the OLED.

In addition, in the drive circuit of the present embodiment, the OLED is forward biased when it emits light, and during the operation stages of the circuit, the OLED is reversely biased. Moreover, when the OLED emits light, the magnitude of the current flowing in the OLED is only dependent on the magnitudes of the data signal voltage and the designed supply voltage $V_{DD0}$, and is independent of the threshold voltage of the drive transistor DTFT. Meanwhile, the current of the OLED for emitting light will not be influenced by the internal resistance of the circuit. During the operation stages of the circuit, the OLED is reversely biased, thus the un-recombined carriers accumulated at the light emitting interface inside the OLED are depleted, eliminating the built-in electrical field formed by these carriers, enhancing injection and recombination of the carriers, and increasing the recombination rate of the carriers. Meanwhile, when the OLED is reversely biased, the locally conductive microcosmic small channels (filaments) are burned out, wherein the filaments are actually caused by some "pinholes". The elimination of the filaments (that is, pinholes) relieves the aging of the OLED, and extending the lifetime of the OLED. Further, in the AC drive circuit for OLED, the data signal voltage is directly written into the storage capacitor $C_{st}$ by charging, and thus the influence of various parasitic capacitances on the data signal voltage is avoided compared to the case that the data signal voltage is written into the storage capacitor by coupling a capacitor. The reason is that, if the data signal voltage is written into the storage capacitor by coupling the capacitor, the jumped voltage due to the coupling will be divided by various parasitic capacitances, thereby the accuracy of the data signal voltage written into the storage capacitor will be influenced.

In the AC drive circuit for OLED of the present invention, thin film transistors manufactured by amorphous-silicon process, poly-silicon process, oxide process, etc. may be used. However, the complexity and cost of the process may be reduced by using a single type of MOS transistors (for example, all of the transistors are P-MOS transistors). Of course, N-MOS transistors or CMOS transistors may be used in the circuit by simplifying, substituting, combining, etc., which belongs to the scope of the present invention.

The AC drive circuit for OELD according to the present invention has a simple structure, wherein thin film transistors manufactured by amorphous-silicon process, poly-silicon process, oxide process, etc. may be used, and the operation of the circuit is simple and convenient, facilitating mass production and application.

It should be understood that, the above implementations are only used to explain the principle of the present invention, but not to limit the present invention. The embodiments of the present invention may omit some technical features of the above technical features so as to only solve a part of existing technical problems, and the disclosed technical features may be combined in any way. The person skilled in the art can make various variations and modifications without departing from the spirit and scope of the present invention, therefore, all equivalent technical solutions fall within the scope of the present invention, and the protection scope of the present invention should be defined by the claims.

The invention claimed is:

1. An AC drive circuit for OLED, comprising:

a storage unit and a drive unit;

a first signal input terminal, a second signal input terminal, and a third signal input terminal;

a light emitting control unit including:

a light emitting control signal input terminal for inputting a light emitting control signal, a first transistor having a gate electrode thereof connected to the light emitting control signal input terminal, a source electrode thereof connected to the first signal input terminal, and a drain electrode thereof connected to the drive unit, and a fourth transistor having a gate electrode thereof connected to the light emitting control signal input terminal, a source electrode thereof transistor connected to the drive unit, and a drain electrode thereof connected to an anode of the OLED; and a charging control unit including:

a scanning signal input terminal for inputting a scanning signal, a data signal input terminal for inputting a data signal, a second transistor having a gate electrode thereof connected to the scanning signal input terminal, a source electrode thereof connected to the data signal input terminal, and a drain electrode thereof connected to the drain electrode of the first transistor, a third transistor having a gate electrode thereof connected to the scanning signal input terminal, a source electrode thereof connected to the storage unit, and a drain electrode thereof connected to the drive unit, and a fifth transistor having a gate electrode thereof connected to the scanning signal input terminal, a source electrode thereof direct connected to the drain electrode of the fourth transistor, and a drain electrode thereof directly connected to the third signal input terminal, wherein the charging control unit is used for controlling the AC drive circuit to charge the storage unit, wherein the light emitting control unit is used for controlling the AC drive circuit so that the storage unit controls the drive unit to drive an OLED to emit light, and wherein the first signal input terminal is connected with the light emitting control unit and the storage unit, the second signal input terminal is connected with a cathode of the OLED, and the third signal input terminal is connected with the charging control unit.

2. The AC drive circuit of claim 1, wherein the drive unit comprises:

a drive transistor, wherein a gate electrode of the drive transistor is connected with the storage unit, a source electrode of the drive transistor is connected with the drain electrode of the first transistor, and a drain electrode of the drive transistor is connected with the source electrode of the fourth transistor.

3. The AC drive circuit of claim 2, wherein the storage unit comprises:

a capacitor, wherein one terminal of the capacitor is connected with the first signal input terminal, and the other terminal of the capacitor is connected with the source electrode of the third transistor.

4. The AC drive circuit of claim 3, further comprises:

a first voltage source for supplying a first voltage control signal to the first signal input terminal.

5. The AC drive circuit of claim 4, further comprises:

a second voltage source for supplying a second voltage control signal to the second signal input terminal.

6. The AC drive circuit of claim 5, further comprises:

a third voltage source for supplying a third voltage control signal to the third signal input terminal.

7. The AC drive circuit of claim 6, wherein all of the first transistor, the second transistor, the third transistor, the fourth transistor, the fifth transistor, and the drive transistor are P-type transistors.

8. The AC drive circuit of claim 7, wherein a voltage magnitude of the first voltage control signal is larger than a voltage magnitude of the second voltage control signal.

9. The AC drive circuit of claim 8, wherein the voltage magnitude of the second voltage control signal is larger than that of the third voltage control signal.

10. A display apparatus, comprising the AC drive circuit for OLED of claim 1.

11. A drive method of an AC drive circuit for OLED, wherein the AC drive circuit comprises a light emitting control unit, a charging control unit, a storage unit, a drive unit, a first signal input terminal, a second signal input terminal, and a third signal input terminal, the charging control unit including a transistor having a gate electrode thereof connected to a scanning signal input terminal of the charging control unit, a source electrode thereof directly connected to the drain electrode of a transistor in the light emitting control unit, and a drain electrode thereof directly connected to the third signal input terminal, the charging control unit is used for controlling the AC drive circuit to charge the storage unit, and the light emitting control unit is used for controlling the AC drive circuit so that the storage unit controls the drive unit to drive an OLED to emit light, the drive method comprises:

turning on the transistor of the charging control unit and the transistor of the light emitting control unit;

removing data signals stored in the storage unit;

turning off the transistor of the light emitting control unit;

charging the storage unit so that new data signals are stored in the storage unit;

isolating the new data signals stored in the storage unit; and controlling the drive unit by the storage unit so that the drive unit drives the OLED to emit light.

12. The drive method of claim 11, further comprising: reversely biasing the OLED while removing data signals stored in the storage unit.

* * * * *